United States Patent [19]

Maynard

[11] 4,084,163

[45] Apr. 11, 1978

[54] TRUNK LID ANTENNA MOUNT

[76] Inventor: L. C. Maynard, 1232 Adams St., St. Joseph, Mich. 49085

[21] Appl. No.: 758,563

[22] Filed: Jan. 12, 1977

[51] Int. Cl.[2] ..... H01Q 1/32

[52] U.S. Cl. ..... 343/715

[58] Field of Search ..... 343/711, 712, 713, 892, 343/715

[56] References Cited

U.S. PATENT DOCUMENTS 4,037,229 7/1977 Dunk ..... 343/715

*Primary Examiner*—Eli Lieberman

*Attorney, Agent, or Firm*—Gust, Irish, Jeffers & Rickert

[57] ABSTRACT

An antenna mount for attaching a whip-type antenna to a peripheral edge of a vehicular trunk lid. The mount comprises an insulative housing having top and side walls defining a cavity, the side wall having a peripheral edge adapted to engage the lid adjacent the edge to close a part of the cavity, a portion of the side wall edge being adapted to extend outwardly beyond the lid edge to define therewith an opening communicating with the cavity. A metallic mounting bracket member is provided having a portion in the cavity engaging the inner surface of the top wall, the bracket member having a clamp portion adapted to embrace the edge of the lid. The clamp portion has an elongated slot formed therein having an end spaced from the distal end of the bracket member to define an end section thereof, the end section having an indentation formed therein aligned with the slot and communicating therewith. Threaded fasteners are provided for securing the clamp portion of the bracket member to the lid adjacent the edge, and a stud extends through aligned openings in the top wall of the housing and the bracket member. A nut on the stud engages the outer surface of the top wall thereby securing the bracket member to the housing, the nut being adapted to have the antenna threadedly attached thereto. An antenna lead has an end in the housing cavity connected to the stud, the lead being disposed in the slot in the clamp portion of the bracket member and in the indentation thereby protecting the lead when the lid is closed.

7 Claims, 6 Drawing Figures

TRUNK LID ANTENNA MOUNT

BACKGROUND OF THE INVENTION

1. Field of the Invention

This invention relates generally to antenna mounts, and more particularly to a trunk lid antenna mount.

2. Description of the Prior Art

In the automotive radio field, it is desirable to provide an antenna mount for securely attaching a whip-type antenna to a vehicle without the necessity for drilling holes therein. The hinged edge of a trunk lid provides a convenient location for attaching an antenna mount without drilling holes in the body of the vehicle; however, in such a mount the antenna lead must extend around the hinged edge of the trunk lid and it is accordingly necessary to protect the lead to prevent abrasion and cutting thereof when the lid is closed. Furthermore, it is necessary to provide adequate electrical shielding for the antenna lead. U.S. Pat. Nos. 3,369,247 and 3,555,551 show such trunk lid antenna mounts.

SUMMARY OF THE INVENTION

In its broader aspects, the invention provides an antenna mount for attaching a whip-type antenna to a peripheral edge of an extended area sheet, the mount comprising a housing having top and side walls mutually defining a cavity, the top wall having an outer surface and an inner surface facing the cavity. The side wall has a peripheral edge with a first portion thereof adapted to engage one surface of the sheet adjacent the edge thereof thereby closing a portion of the cavity, a second portion of the side wall edge being adapted to extend outwardly beyond the sheet edge thereby defining therewith an opening communicating with the cavity. A mounting bracket member is provided having a first portion in the cavity and engaging the inner surface of the top wall, the top wall and the first mounting bracket portion having aligned openings formed therethrough. The bracket has a clamp portion joined to the first portion and having a distal end, the clamp portion being adapted to embrace the edge of the sheet. The clamp portion has an elongated slot formed therein having an end spaced from the distal end to define an end section, the end section having an indentation formed therein aligned with the slot and communicating therewith and with the distal end. First means is provided for securing the clamp portion to the sheet adjacent its edge, and second means is provided extending through the housing top wall and bracket member openings for securing the bracket member to the housing. The second securing means includes a first portion in engagement with the outer surface of the top wall adapted to have the antenna attached thereto, and a second portion in the cavity engaging the first bracket member portion. An antenna lead has an end in the cavity connected to the securing means, the lead having a portion disposed in the bracket member clamp portion slot and indentation and adapted to extend outwardly between the indentation and the sheet.

It is accordingly an object of the invention to provide an improved trunk lid antenna mount.

Another object of the invention is to provide an improved trunk lid antenna mount which does not require the drilling of holes in the vehicle body, and which includes improved means for protecting the antenna lead.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
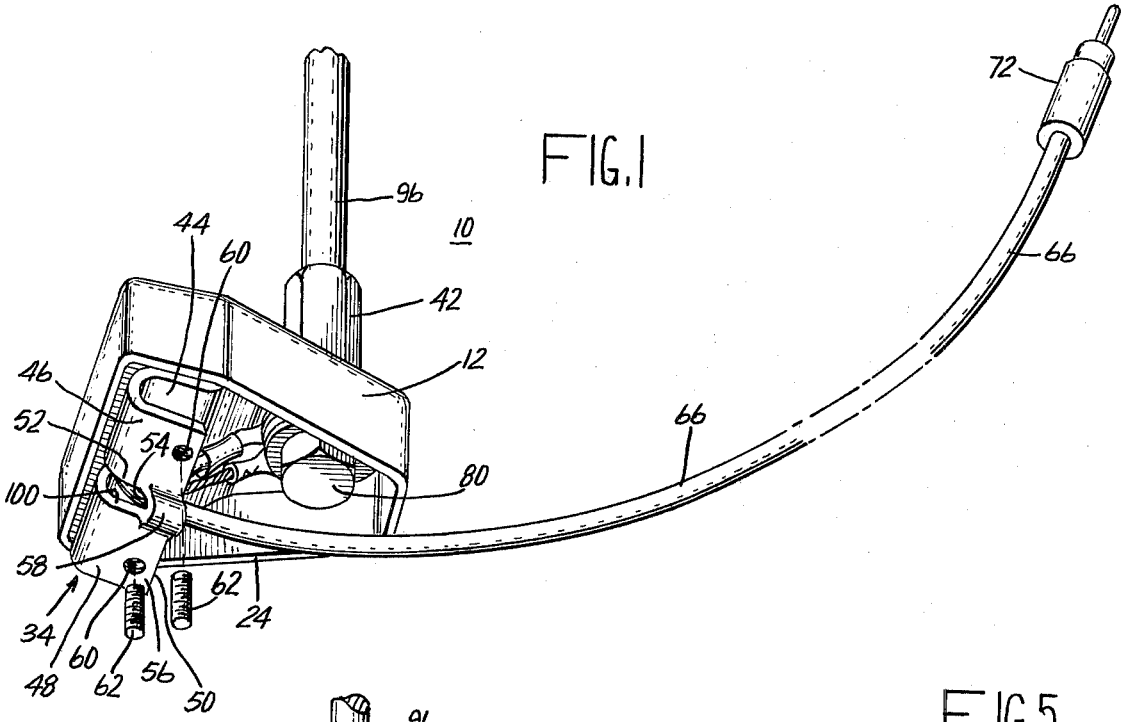
FIG. 1 is a bottom perspective view of the improved trunk lid antenna mount of the invention.

Referring now to the figures of the drawing, the improved trunk lid antenna mount of the invention, generally indicated at 10, comprises a housing or cap 12 formed of suitable insulating material, preferable molded plastic material, housing 12 having top wall 14 and side wall 16 mutually defining cavity 18. Top wall 14 has top surface 20 and bottom surface 22 facing cavity 18.

Side wall 16 of housing 12 has peripheral edge 24, mount 10 being assembled on trunk lid 26 in such a manner that a first portion 24-1 engages upper surface 28 of trunk lid 26 and a second portion 24-2 extends outwardly beyond hinged edge 30 of trunk lid 26 to define opening 32 therewith.

Figure 2:
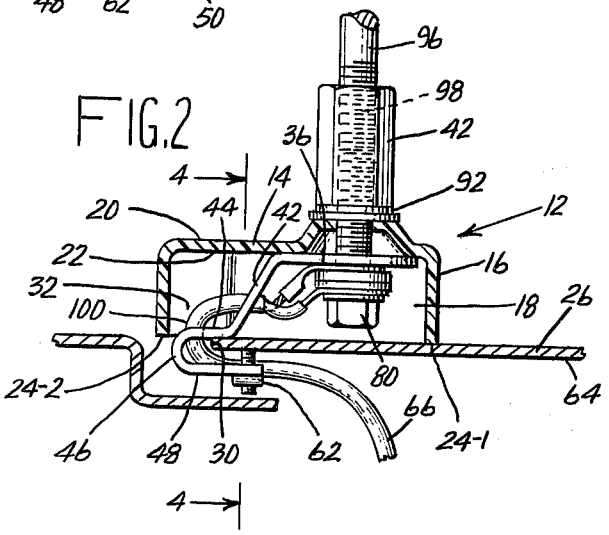
FIG. 2 is a cross-sectional view showing the antenna mount of the invention secured to the trunk lid of the vehicle.
Figure 5:
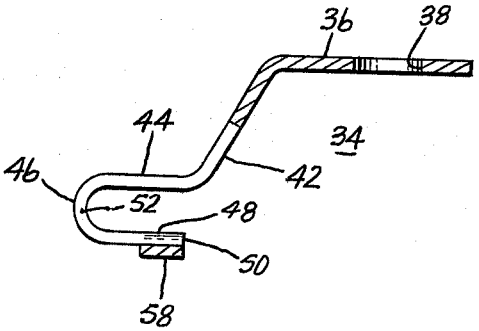
FIG. 5 is a side cross-sectional view of the mounting bracket.
Figure 6:
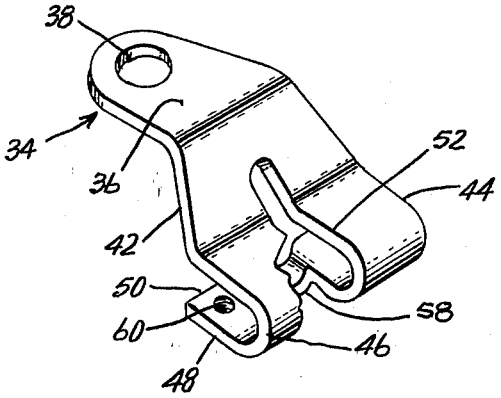
FIG. 6 is a perspective view further showing the mounting bracket.
Figure 3:
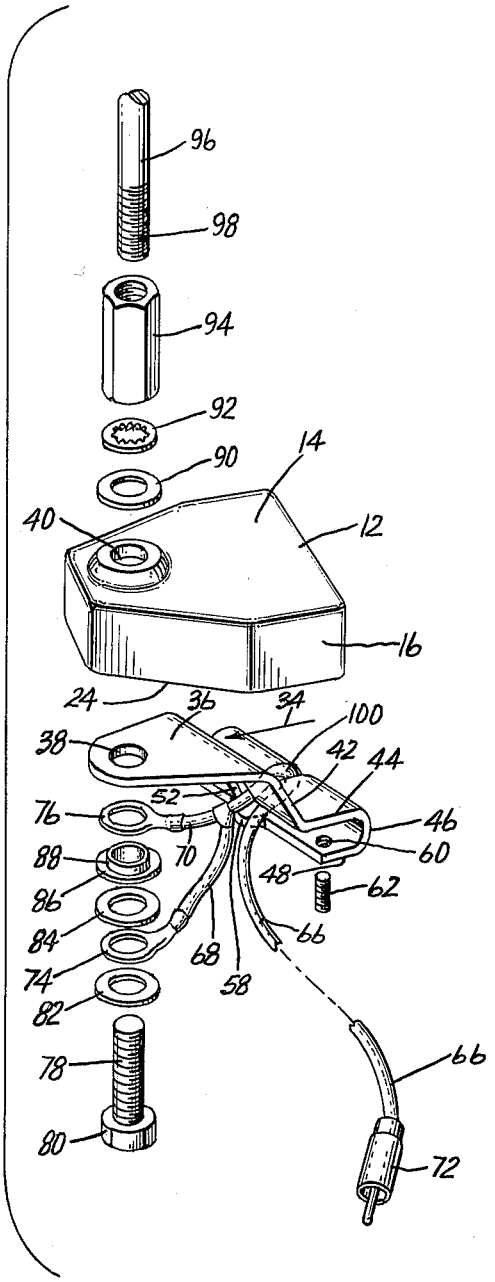
FIG. 3 is an exploded perspective view of the antenna mount of the invention.

Mounting bracket 34 formed of suitable metal, preferably brass, has first portion 36 engaging inner surface 22 of housing 14. Bracket portion 36 and top wall 14 of housing 12 have aligned openings 38, 40 formed therein. Bracket member 34 has second portion 42 joining portions 36 and 44. Bracket portions 36, 44 lie in generally parallel planes, portion 42 being inclined with respect thereto, as best seen in FIGS. 2 and 5. Portion 44 of bracket member 34 is joined to portion 46 which extends downwardly through opening 32. Portion 46 is joined to portion 48 which is spaced from and generally parallel with portion 44 and terminates at distal end 50. It will be seen that portions 44, 46, 48 of bracket member 34 form a generally U-shaped clamp portion which embraces edge 30 of lid 26, as best seen in FIG. 2.

Portions 42, 44, 46 and 48 of bracket member 34 have elongated slot 52 formed therein which has end 54 spaced from distal end 50 of portion 48 to define end section 56 of bracket member 34. Indentation 58 is formed in end section 56 in alignment with slot 58 and communicating between slot 58 and end 50.

Tapped holes 60 are formed in end section 56 of bracket member 36 which receive Allen head screws 62. Screws 62 engage lower surface 64 of lid 26 thereby forcing portion 44 of bracket member 34 into engagement with upper surface 28 of lid 26 and securely clamping antenna mount 10 to lid 26.

Antenna lead 66 is provided conventionally having insulated inner conductor 68, an outer conductive sleeve terminating in conductor 70, and an outer insulative coating. Conventional connector 72 is connected to the end of antenna lead 66 for connecting the same to another lead for connection to radio equipment in the vehicle. Conductor 68 has conventional lug 74 connected to its end and conductor 70, which is extension of the conductive, shielding sleeve, has conventional lug 76 connected to its end.

Conventional threaded bolt 78 having head 80 thereon has metallic washer 82, lug 74, metallic washer 84, and insulative washer 86 assembled thereon. Insulative washer 86 has sleeve portion 88 having lug 76 assembled thereon. Sleeve portion 88 of insulative washer 86 is received in opening 38 in portion 36 of bracket member 34. Bolt 78, insulated by insulative washer 86, extends through opening 38 in portion 36 of bracket member 34, and through opening 40 in housing 14, and has metallic washer 90, lock washer 92 and elongated nut 94 assembled thereon, nut 94 and head 80 of bolt 78 cooperating to secure bracket member 34 to housing 12, as best seen in FIG. 2. Conventional whip-type antenna has end 98 threadedly secured to nut 94, thereby attaching antenna 96 to trunk lid 28.

Figure 4:
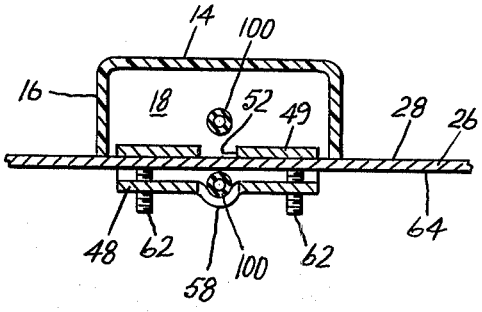
FIG. 4 is a cross-sectional view taken generally along the line 4—4 of FIG. 2.

Antenna lead 66 has portion 100 intermediate connector 72 and lugs 74, 76 which is disposed in slot 52 and indentation 58. As best seen in FIG. 4, portion 100 of lead 66 is thus disposed between indentation 58 and lower surface 64 of trunk lid 26.

It will now be seen that central conductor 68 of antenna lead 66 is connected to antenna 96 by means of lug 74 and bolt 78, the outer conductive, shielding sleeve and its conductor 70 being connected to ground by virtue of connection of lug 76 to bracket member 34 and trunk lid 26, thus providing the requisite noise suppression. It will further be seen that the positioning of portion 100 of antenna lead 66 in slot 52 and indentation 58 of bracket member 34 protects antenna lead 66 against cutting and abrasion where the lead extends around edge 30 of trunk lid 26. It will further be seen that antenna mount 10 is readily assembled on trunk lid 26 without requiring the drilling of holes therein.

While there have been described above the principles of this invention in connection with specific apparatus, it is to be clearly understood that this description is made only by way of example and not as a limitation to the scope of the invention.

What is claimed is:

1. An antenna mount for attaching a whip-type antenna to a peripheral edge of an extended area sheet comprising:

(a) a housing having top and side walls mutually defining a cavity, said top wall having an outer surface and an inner surface facing said cavity, said side wall having a peripheral edge with a first portion thereof being adapted to engage one surface of said sheet adjacent said edge thereof thereby closing a portion of said cavity and with a second portion adapted to extend outwardly beyond said sheet edge thereby defining therewith an opening communicating with said cavity:

(b) a mounting bracket member having a first portion in said cavity and engaging said inner surface of said top wall, said top wall and said first portion having aligned openings formed therethrough, and a clamp portion adapted to embrace said sheet edge, and having a distal end, said clamp portion having an elongated slot formed therein having an end spaced from said distal end to define an end section thereof, said end section having an indentation formed therein aligned with said slot and communicating therewith and with said distal end;

(c) first means for securing said clamp portion to said sheet adjacent said edge;

(d) second means extending through said housing top wall and first bracket member portion openings for securing said bracket member to said housing, said second securing means including a first portion in engagement with said outer surface of said top wall and adapted to have said antenna attached thereto, and a second portion in said cavity engaging said first bracket member portion; and (e) an antenna lead having an end in said cavity connected to said securing means, said lead having a portion disposed in said bracket member clamp portion slot and indentation and adapted to extend outwardly between said indentation and said sheet.

2. The mount of claim 1 wherein said sheet, bracket member and second securing means are formed of metal, said housing being formed of insulative material, and further comprising:

(f) means for insulating said second securing means from said bracket member.

3. The mount of claim 2 wherein said lead includes first and second conductors, said first conductor being connected to said bracket member portion and said second conductor being connected to said second securing means.

4. The mount of claim 3 wherein said second securing means comprises a threaded stud with said first portion thereof being a nut threaded thereon and said second portion being the head thereof, said nut being adapted to have said antenna threadedly attached thereto;

said insulating means comprising an insulative washer having a portion extending into said first bracket member opening and insulating said stud therefrom;

said first conductor having a first lug on its end surrounding said washer portion and thereby being insulated from said stud, said first lug being forced into conductive engagement with said first bracket member portion by said washer;

said second conductor having a second lug on its end surrounding said stud and conductively engaging said head thereof.

5. The mount of claim 4 wherein said bracket member clamp portion comprises:

a second portion in said cavity joined to said first portion and adapted to engage said one surface of said sheet, a third portion joined to said second portion and adapted to extend outwardly through said cavity opening, and a fourth portion joined to said third portion extending generally parallel with said third portion and having said distal end.

6. The mount of claim 5 wherein said first bracket member portion and said second portion lie in spaced generally parallel planes, said first portion being joined to said second portion by an inclined portion extending between said planes.

7. The mount of claim 6 wherein said sheet is a trunk lid hinged adjacent said edge thereof to another metal sheet forming a part of a vehicle body, said other sheet having a shoulder joined to a flange portion which terminates in another edge, said lid when closed being generally coplanar with said other sheet with said lid edge closely spaced from said shoulder and said flange spaced from and generally parallel with said lid;

said clamp portion being generally U-shaped;

said first securing means being fasteners threaded in openings in said fourth bracket member portion on opposite sides of said indentation and engaging the other surface of said lid adjacent said edge thereof thereby forcing said second portion into engagement with said one surface thereof;

said third bracket member portion being adapted to extend through the space between said lid edge and said shoulder when said lid is closed;

said fourth bracket member portion being adapted to be disposed in the space between said lid and said flange when said lid is closed.

* * * * *